US007160493B2

(12) United States Patent
Willis et al.

(10) Patent No.: US 7,160,493 B2
(45) Date of Patent: Jan. 9, 2007

(54) RETAINING RING FOR USE ON A CARRIER OF A POLISHING APPARATUS

(75) Inventors: George D. Willis, Ormond Beach, FL (US); William G. Easter, Chuluota, FL (US)

(73) Assignee: Semplastics, LLC, Daytona Beach, FL (US)

( * ) Notice: Subject to any disclaimer, the term of this patent is extended or adjusted under 35 U.S.C. 154(b) by 224 days.

(21) Appl. No.: 10/684,358

(22) Filed: Oct. 10, 2003

(65) Prior Publication Data

US 2004/0077167 A1 Apr. 22, 2004

Related U.S. Application Data

(60) Provisional application No. 60/418,144, filed on Oct. 11, 2002.

(51) Int. Cl.
*B24B 5/00* (2006.01)
*C23F 1/00* (2006.01)

(52) U.S. Cl. ..... 264/162; 451/31

(58) Field of Classification Search ..... 451/31; 216/88; 264/162, 154, 155, 156
See application file for complete search history.

(56) References Cited

U.S. PATENT DOCUMENTS 5,205,082 A 4/1993 Shendon et al.
5,533,924 A * 7/1996 Stroupe et al. ..... 451/286
5,635,083 A 6/1997 Breivogel et al.
5,645,474 A 7/1997 Kubo et al.
5,691,372 A 11/1997 Tung et al.
5,803,799 A 9/1998 Volodarsky et al.
5,883,899 A * 3/1999 Dahlman et al. ..... 370/468
5,948,204 A 9/1999 Maveety et al.
6,024,630 A 2/2000 Shendon et al.
6,106,661 A 8/2000 Raeder et al.
6,113,479 A 9/2000 Sinclair et al.
6,121,143 A 9/2000 Messner et al.
6,186,880 B1 * 2/2001 Gonzalez et al. ..... 451/397
6,220,930 B1 4/2001 Lin et al.
6,224,472 B1 5/2001 Lai et al. ..... 451/398
6,251,215 B1 6/2001 Zuniga et al.
6,264,540 B1 * 7/2001 Fruitman ..... 451/398
6,276,998 B1 8/2001 Sommer et al.

(Continued)

FOREIGN PATENT DOCUMENTS

DE 201 11 766 U 1 11/2002

(Continued)

OTHER PUBLICATIONS

Slezak et al. Sawing, 1980. ASM, 9th Ed., pp. 356-365.*

(Continued)

*Primary Examiner*—Parviz Hassanzadeh
*Assistant Examiner*—Sylvia R. MacArthur
(74) *Attorney, Agent, or Firm*—Barley Snyder LLC

(57) ABSTRACT

The invention provides a unitary retaining ring for use in a CMP apparatus. The retaining ring features a pad engaging surface which is designed to be flat and planar when the retaining ring is mounted to a carrier of the CMP apparatus. The pad engaging surface includes portions which surround the wafer and contact a pad and slurry on the CMP apparatus. A plurality of mounting features are provided along a carrier engaging surface of the ring. The mounting features are installed to cause localized compressive stresses in the material when in a demounted state. Upon mounting to a carrier of the CMP apparatus under specified torque or force conditions, tensile stresses are applied to the material of the ring resulting in a flat and planar mounted front surface.

3 Claims, 7 Drawing Sheets

U.S. PATENT DOCUMENTS

| | | | | |
|---|---|---|---|---|
| 6,290,577 | B1 | 9/2001 | Shendon et al. | |
| 6,290,584 | B1 * | 9/2001 | Kim et al. | 451/288 |
| 6,354,927 | B1 * | 3/2002 | Natalicio | 451/287 |
| 6,394,023 | B1 | 5/2002 | Crocker | |
| 6,443,824 | B1 | 9/2002 | Shendon et al. | |
| 6,585,850 | B1 | 7/2003 | Kenji et al. | 156/345.12 |
| 6,602,116 | B1 * | 8/2003 | Prince | 451/51 |
| 6,758,939 | B1 * | 7/2004 | Marquardt et al. | 156/345.14 |
| 6,913,669 | B1 * | 7/2005 | Ensinger | 156/345.14 |
| 2001/0000770 | A1 | 5/2001 | Lin et al. | |
| 2001/0007795 | A1 | 7/2001 | Kawamura et al. | |
| 2001/0041521 | A1 | 11/2001 | Quek | 451/287 |
| 2001/0041522 | A1 | 11/2001 | Shendon et al. | |
| 2002/0017365 | A1 | 2/2002 | Gunji et al. | |
| 2002/0019199 | A1 | 2/2002 | Goers et al. | |
| 2002/0037683 | A1 | 3/2002 | Goers et al. | |
| 2002/0049026 | A1 | 4/2002 | Katagiri et al. | |
| 2002/0086624 | A1 * | 7/2002 | Zuniga et al. | 451/56 |
| 2002/0164926 | A1 * | 11/2002 | Simon | 451/28 |
| 2002/0182867 | A1 * | 12/2002 | Kajiwara et al. | 438/692 |
| 2003/0224703 | A1 * | 12/2003 | Moloney et al. | 451/36 |
| 2004/0077167 | A1 * | 4/2004 | Willis et al. | 438/689 |
| 2004/0152403 | A1 * | 8/2004 | Marohl et al. | 451/442 |
| 2004/0261945 | A1 * | 12/2004 | Ensinger | 156/345.12 |

FOREIGN PATENT DOCUMENTS

| | | |
|---|---|---|
| JP | 2001121411 | 5/2001 |
| WO | WO 01 89763 A | 11/2001 |

OTHER PUBLICATIONS

Handbook of Stainless Steels. McGraw Hill: 1977, 24-20-24-23.*

Steigerwald, et al., "Chemical Mechanical Planarization-An Introduction," *Chemical Mechanical Planarization of Microelectronic Materials Textbook*, pp. 1-81 (1997).

Nishi, et al., "Chemical-Mechanical Polish," *Handbook of Semiconductor Manufacturing Technology*, pp. 419-432 (2000).

* cited by examiner

RETAINING RING FOR USE ON A CARRIER OF A POLISHING APPARATUS

This application claims the benefit of U.S. Provisional Application(s) No. 60/418,144 filed Oct. 11, 2002.

FIELD OF THE INVENTION

The present invention relates generally to chemical mechanical polishing devices which are utilized for polishing substrates. More particularly, the invention is related to an improved unitary retaining ring for use on a carrier head of a chemical mechanical polishing apparatus.

BACKGROUND OF THE INVENTION

Chemical Mechanical Polishing (CMP) is a known means of planarizing semi-conductor layers which are built up on a silicon wafer substrate. Integrated circuits are typically formed on these substrates by sequential deposition of conductive, semi-conductive, or insulative layers. After each layer is deposited, an etching process is employed to create circuitry features on the silicon wafer. Through this sequential deposition and etching process, the outer most surface of the substrate becomes increasingly non-planar. This non-planar surface presents problems in the photolithographic steps of integrated circuitry fabrication therefore necessitating intermediate planarization steps in the process.

CMP typically utilizes an abrasive slurry dispersed in solution in combination with mechanical and chemical action along a surface of the wafer. One type of CMP polishing system has a rotatable circular platen or table on which a polishing pad is mounted. A multi-head or single head polishing device is positioned above the table. The polishing device has either a single or multiple rotating carrier heads to which wafers can be secured typically through the use of vacuum pressure or other securing methods. The platen is rotated and an abrasive slurry dispersed onto a polishing pad of the platen. Once the slurry has been applied to the polishing pad, the rotating carrier heads move downward to press corresponding wafers against the polishing pad. As the wafers are pressed against the polishing pad, the surface of the wafer is mechanically and chemically polished. As a result of both previous semiconductor operations and CMP processing, the finish will include undesirable aspects such as defect counts and cleanliness of the polished surface. The effectiveness of a CMP process may be measured by its polishing rate, and by the resulting finish and flatness of the substrate surface. The polishing rate, finish and flatness are determined by the pad and slurry combination, the relative speed between the substrate and the pad, and the force pressing the substrate against the pad.

It is desirable to maximize the effectiveness of the CMP process by increasing the polishing rate and improving the resulting finish and flatness of the substrate surface. Retaining rings secured to the carrier have been developed to improve the resulting finish and flatness of the substrate surfaces. The flatness and planarity of the ring is critical to maintaining finish and flatness of the processed wafer. For example, U.S. Pat. No. 6,251,215 teaches a carrier head having a substrate mounting surface and a retaining ring to maintain a substrate beneath the mounting surface during polishing. The retaining ring is formed of two parts which include a lower portion having a bottom surface for contacting a polishing pad during polishing and an upper portion which is secured to the carrier head. The upper portion is formed of a material which is more rigid than the material of the lower portion. The rigid upper portion is said to be advantageous because it contributes to resulting flatness and finish of the substrate near its edges. This upper portion is therefore precision machined to be very flat and planar. It is desirable to have a flat ring pressing on the polishing pad to avoid flatness variations in the polished wafer. The lower portion wears during operation due to its contact with the polishing pad and is therefore a consumable in the process. The retaining ring as taught by this reference may be refurbished by replacing the lower portion upon wear.

Several problems exist in that this refurbishing process is time consuming and costly. During this refurbishing process the spent worn lower portion is removed from the relatively expensive precision machined upper portion and a new lower portion is applied generally using an adhesive. The application process involves steps to ensure flatness and planarity of the lower portion especially along its pad engaging surface. Other problems arise with refurbishing in tracking parts as well as the potential for cross-contamination of precision machined upper portions from copper metal system fabs coming in contact with those from non-copper metal system fabs.

SUMMARY OF THE INVENTION

The invention provides a unitary retaining ring for use in a CMP apparatus. The retaining ring features a pad engaging surface which is designed to be flat and planar when the retaining ring is mounted to a carrier of the CMP apparatus. A plurality of mounting features are provided along a carrier engaging surface of the ring. The mounting features are installed to cause localized compressive stresses in the material when in a de-mounted state. Upon mounting to a carrier under specified torque or force conditions, tensile stresses are applied to the material of the ring resulting in a flat and planar mounted front surface.

BRIEF DESCRIPTION OF THE DRAWINGS

The invention will now be described by way of example with reference to the accompanying figures of which.

DETAILED DESCRIPTION OF THE INVENTION

Figure 1:
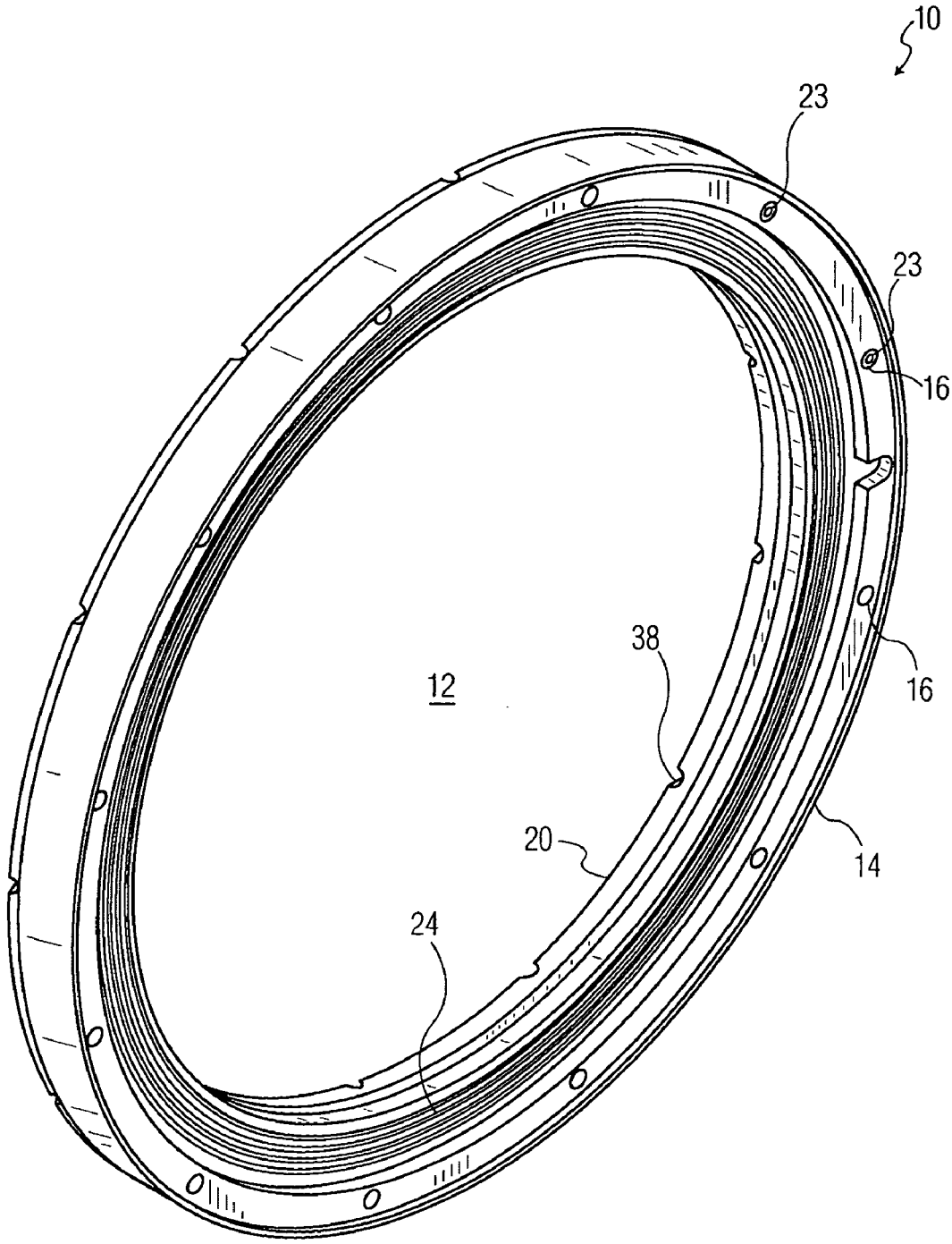
FIG. 1 is a perspective view of a retaining ring according to the present invention.
Figure 2:
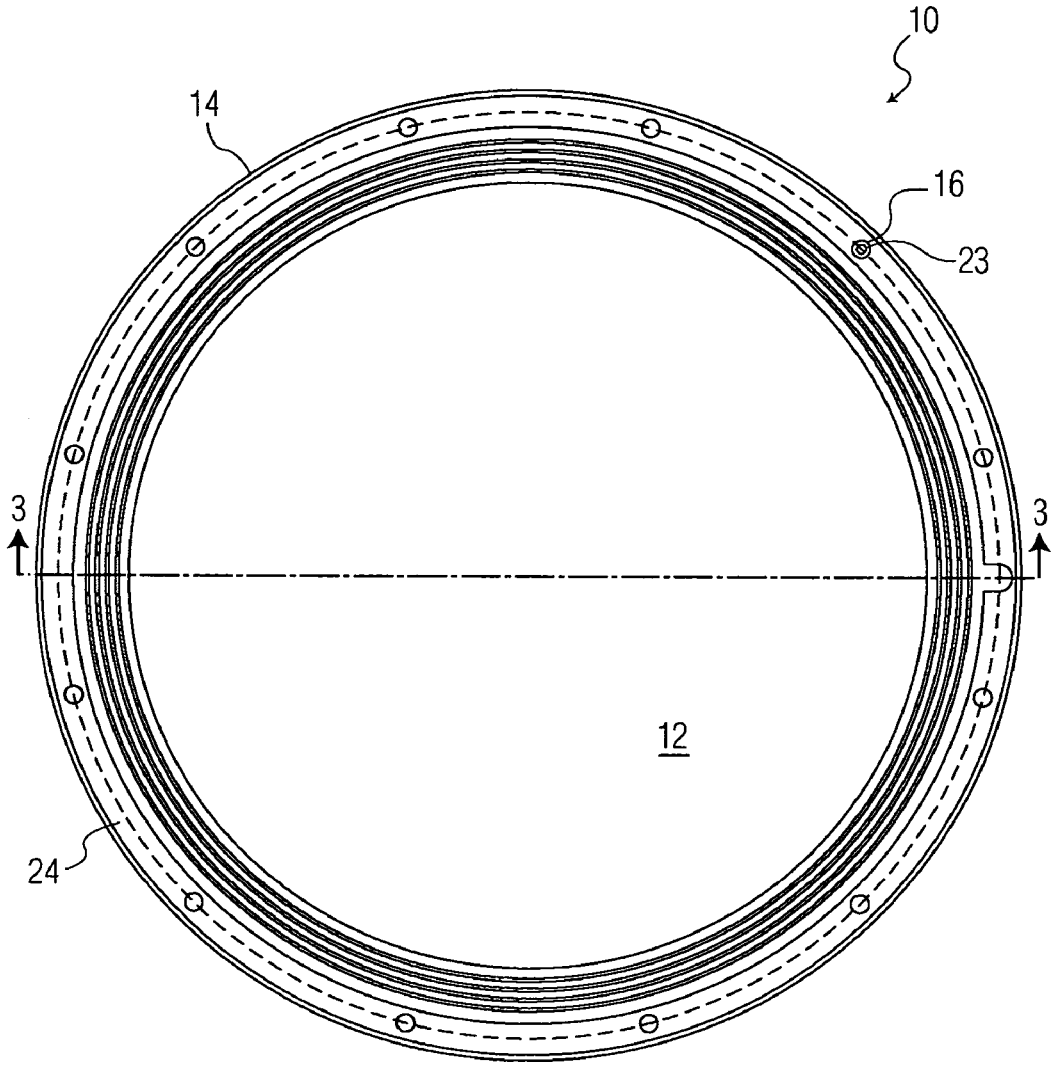
FIG. 2 is a front view of the retaining ring of FIG. 1.

The invention will first be described generally with reference to FIGS. 1–6. A unitary retaining ring 10 is shown having a generally circular shape. The retaining ring 10 has an annular rim 14 extending around the periphery of an opening 12. A plurality of mounting features 16 are formed along the annular rim 14 on a profiled carrier engaging surface 24. As best shown in FIGS. 1 and 6, the retaining ring 10 has a profiled carrier engaging surface 24 opposite a pad engaging surface 20.

The retaining ring 10 is formed of a unitary construction and preferably formed of a material which is chemically inert in a CMP process. Plastic materials that have been found to be suitable include but are not limited to polyphenylene sulfide (PPS), polyethylene terephthalate (PET), polyetheretherketone (PEEK) or polybutylene terephthalate (PBT), polyoxymethylene (POM), C-10 as is commercially available from Semplastics or other suitable composite materials. The mounting features 16 are formed by first drilling a blind hole into the carrier engaging surface 24 at a plurality of locations around the annular rim 14. A metallic reinforcing member 23 such as a threaded insert is then inserted into the blind hole forming an interference fit therebetween.

Figure 3:
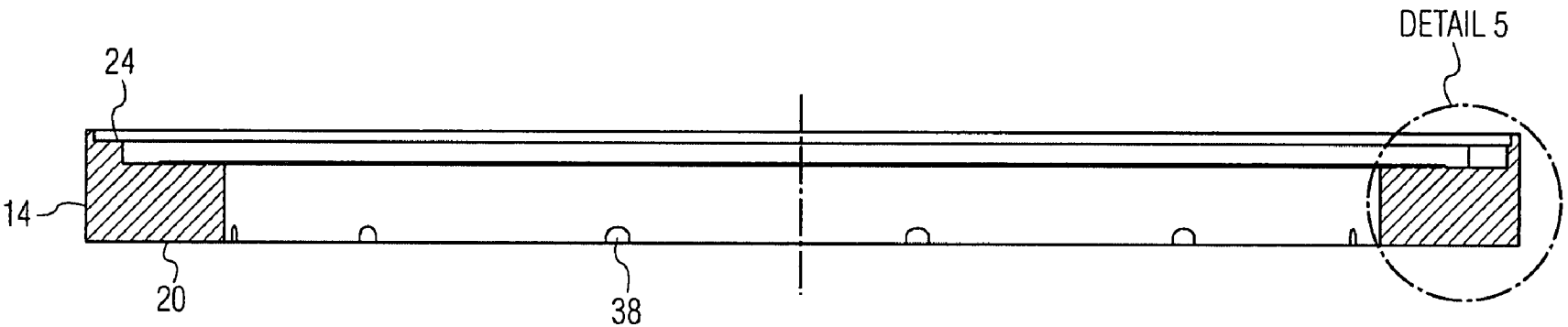
FIG. 3 is a cross sectional view of the retaining ring taken along the line 3—3 of FIG. 2.
Figure 4:
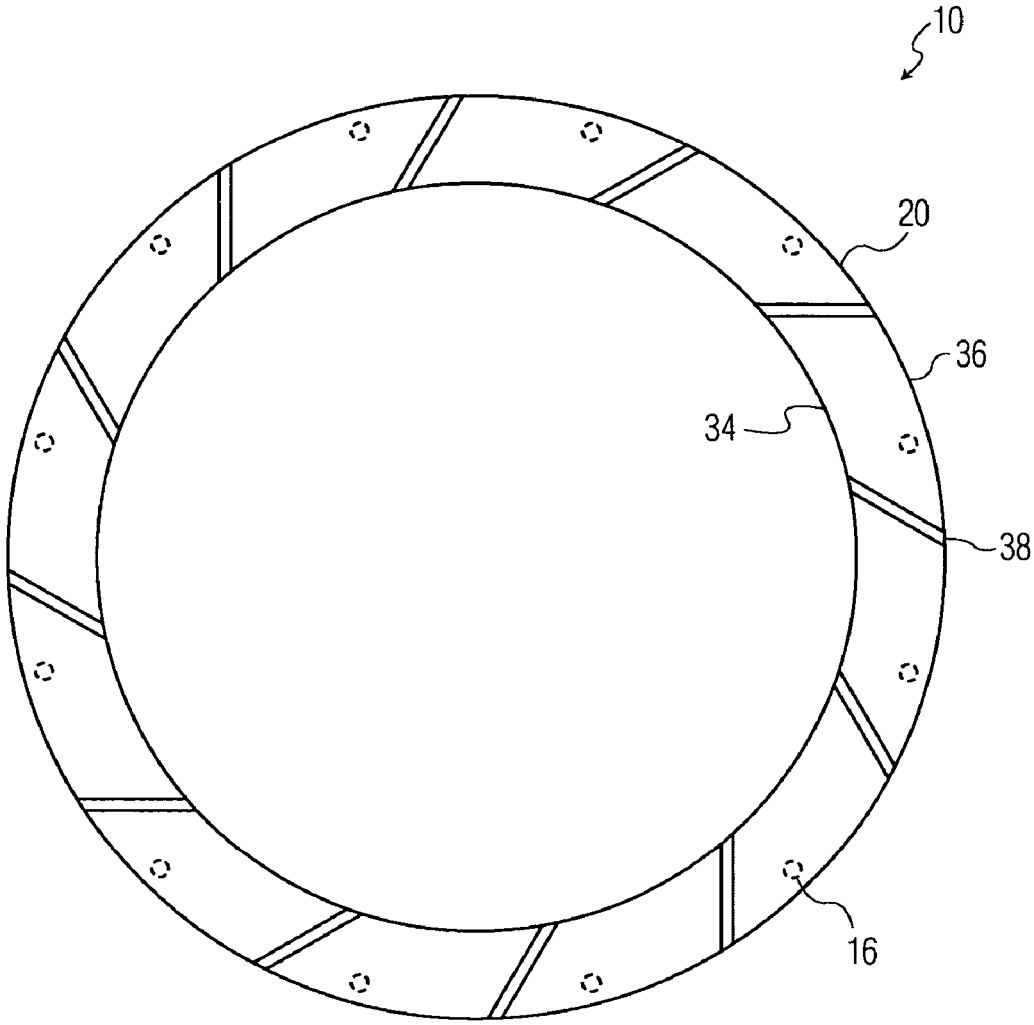
FIG. 4 is a back view of the retaining ring of FIG. 1.
Figure 5:
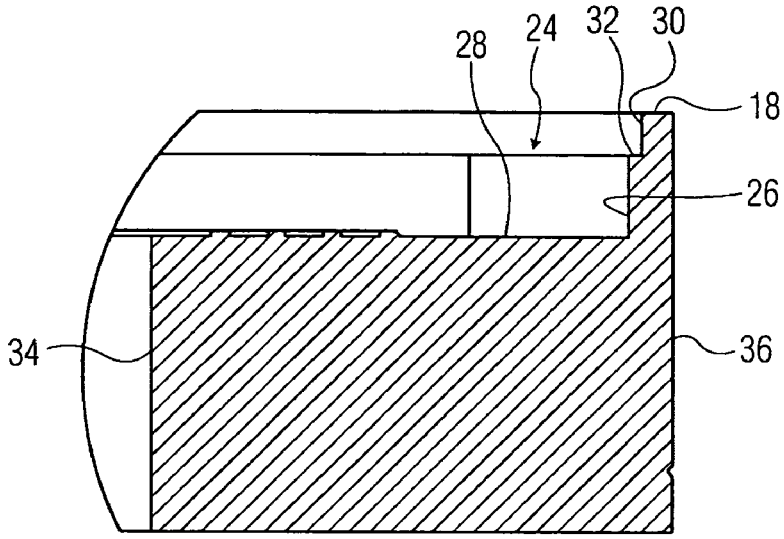
FIG. 5 is a detail exploded view of the section marked "Detail 5" in FIG. 3.
Figure 6:
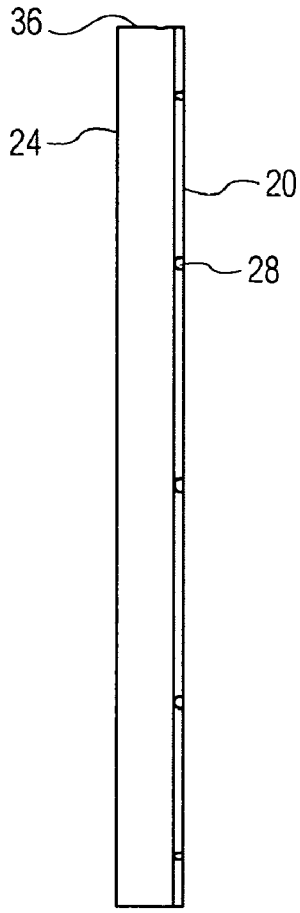
FIG. 6 is a side view of the retaining ring of FIG. 1.

Referring now to FIGS. 3 and 5, the annular rim 14 will now be described in greater detail. The annular rim 14 is generally planar along the pad engaging surface 20. The pad engaging surface 20 features a plurality of semicircular channels 38 extending from the inner surface 34 to the outer surface 36. These channels 38 are cut to a depth with a semicircular or arcuate profile to allow for adequate transport of slurry and CMP byproducts to and from the wafer surface during CMP processing. The semicircular or arcuate profile of the channels 38 advantageously prevents creep in the material that would otherwise result from a sharp edge or rectangular profiled channel. The arcuate or semicircular profile also serves to better and more uniformly distribute stresses in the mounted retaining ring 10 thus contributing to maintaining flatness and planarity of the mounted retaining ring 10 especially along the pad engaging surface 20. The opposite carrier engaging surface 24 is profiled such that a portion of it forms an annular ridge 18 (FIG. 5) extending around an outer surface 36. Beginning at the outer surface 36 and moving inward, the annular ridge 18 extends to a first ledge 30. An intermediate surface 32 extends from the first ledge 30 to a second ledge 26. A recessed surface 28 extends from the second ledge 26 inward to an inner surface 34 of the annular rim 14 beginning at the outer surface 36. It should be understood by those reasonably skilled in the art that the carrier engaging surface 24 may alternatively be profiled to be complementary to various carriers. For example, some carriers do not require the annular ridge 18 and first ledge 30 which may be eliminated to accommodate those carriers.

Figure 7:
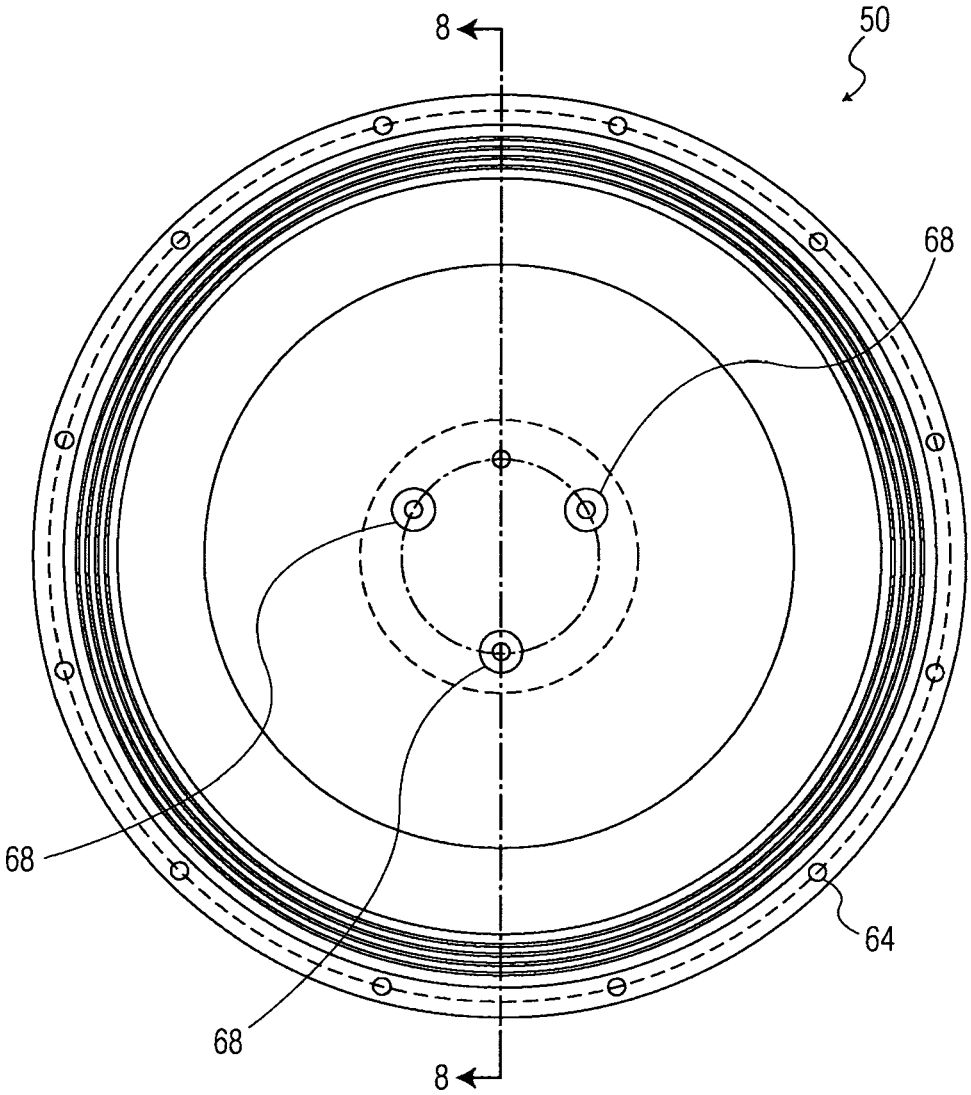
FIG. 7 is a front view of a test mount for the retaining ring of FIG. 1.
Figure 8:
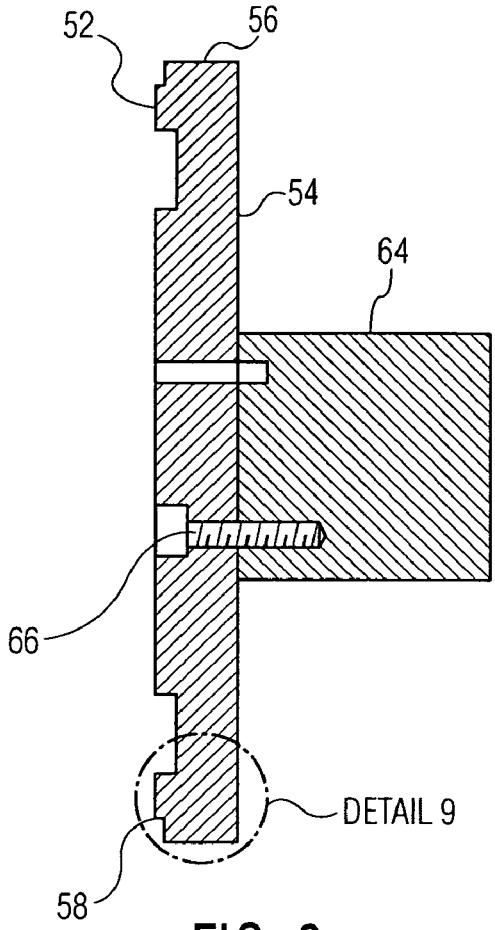
FIG. 8 is a cross sectional view of the test mount taken along the line 8—8 of FIG. 7.
Figure 9:
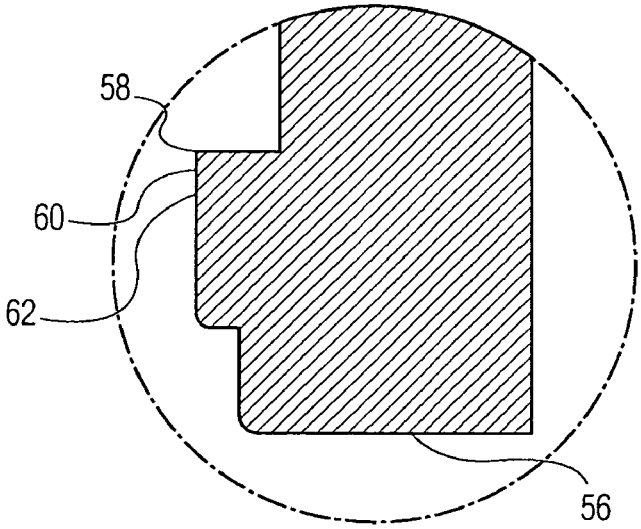
FIG. 9 is an exploded detail view of the section marked "Detail 9" shown in FIG. 8.

The mounting fixture 50 will now be described in greater detail with reference to FIG. 7. The mounting fixture 50 is formed of a rigid material and features a mounting surface 52 and a back surface 54 which are joined to each other by an outer surface 56. The mounting surface 52 designed to simulate a carrier of CMP processing equipment. For example, as shown in FIG. 8, a ring engaging section 58 is profiled to have a series of projections 60 and recesses 62 which are selected to be exactly the same as the CMP processing equipment which will ultimately receive the retaining ring 10. A plurality of mounting features 64 are located around the ring engaging section 58 and are positioned to receive fasteners such as bolts which engage each of the mounting features 16 on the ring 10. The back surface 54 is connected to a mount 64 utilizing a appropriate fasteners 66. A plurality of fastener receiving openings 68 pass from the front surface 52 through to the back surface 54 approximately in the center of the mounting fixture 50.

The retaining ring 10 is manufactured by first forming the selected material into a cylindrical or tubular shape. Inside and outside diameter dimensions are selected and the inner and outer surfaces 34,36 are formed by machining or by other suitable plastic forming methods. The carrier engaging surface 24 is then machined to be planar along the profile described above. The plurality of mounting features 16 are then formed on the carrier engaging surface 24 by first drilling and then inserting the reinforcing members 23 into the holes. A localized compressive stress results in the annular rim 14 in the vicinity of the inserted reinforcing member 23 by virtue of the fit between the hole and the reinforcing member 23. The retaining ring 10 is then mounted to the fixture 50 of FIG. 6. In this mounting operation, fasteners such as bolts are passed through holes 64 and secured in the reinforcing members 23 of the mounting features 16 at a specified torque. In mounting this way, the material surrounding the reinforcing members 23 experiences a localized tensile stress in the annular rim 14 where the insertion of the reinforcing member previously caused a localized compressive stress as described above. The pad engaging surface 20 is then machined to achieve desired flatness and planarity when the retaining ring 10 is in a mounted state. This step includes machining the semicircular channels 38 in the pad engaging surface 20. The retaining ring 10 is then de-mounted from the fixture 50. It should be understood that once de-mounted, the ring 10 may not exhibit the required flatness along the pad engaging surface 20 due to the removal of tensile forces applied by the mounting process. When mounted in CMP equipment under specified mounting torque along each of the mounting features 16, the retaining ring 10 is designed to conform to required flatness standards along the pad engaging surface 20.

In use the retaining ring 10 is mounted in a CMP apparatus to its carrier. A specified torque is applied to the fasteners and reinforcing members 23 such that tensile forces are applied in the vicinity of the mounting features 16 as described above in the mounting step. Since the retaining ring was manufactured to include processing and profiling steps in a mounted state, the retaining ring 10 will exhibit the desired flatness and planarity along the pad engaging surface 20 when remounted in the CMP carrier. A wafer is then placed into the opening 12 and polished along a pad with slurry as is well known in the art. Since flatness and planarity is achieved without the need for a two part ring having a ridged back layer, once the retaining ring is spent or worn it may be discarded without the need for expensive refurbishing to save the precision machined back layer.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A method of making a unitary retaining ring for use in a Chemical Mechanical Polishing (CMP) apparatus comprising the steps of:

forming a ring from a cylindrical or tubular plastic material;

machining inside and outside diameter dimensions to form inner and outer surfaces on the ring;

machining a planar carrier engaging surface on the ring between the inner and outer surfaces;

forming a plurality of mounting features on the carrier engaging surface in a manner causing a localized compressive stress in the area surrounding the mounting feature;

mounting the ring to a fixture which simulates the mount of a CMP apparatus;

machining a flat pad engaging surface on the ring between the inner and outer surfaces opposite the carrier engaging surface; and, demounting the ring from the fixture.

2. The method of claim 1 wherein the mounting features are formed by first drilling holes into the carrier engaging surface and then inserting a reinforcing member in each hole.

3. The method of claim 2 wherein the retaining ring is mounted to the fixture by fasteners passing through holes in the fixture and secured to the reinforcing members of the mounting features causing a localized tensile stress in the ring.

* * * * *